US005315937A

United States Patent [19]

Williams

[11] Patent Number: 5,315,937

[45] Date of Patent: May 31, 1994

[54] WASTE MATERIAL COMBUSTION ASH EJECTION SYSTEM

[76] Inventor: Robert M. Williams, 16 La Hacienda, St. Louis, Mo. 63124

[21] Appl. No.: 925,913

[22] Filed: Aug. 7, 1992

[51] Int. Cl.[5] ..... F23J 1/00

[52] U.S. Cl. ..... 110/165 A; 110/255; 110/259; 110/165 R

[58] Field of Search ..... 110/245, 165 A, 165 R, 110/255, 259

[56] References Cited

U.S. PATENT DOCUMENTS

| | | | |
|---|---|---|---|
| 4,230,559 | 10/1980 | Smith | 209/139 |
| 4,593,477 | 6/1986 | Dziubakowski et al. | 34/10 |
| 4,608,944 | 9/1986 | Kärnä122 | 4 D/ |
| 4,628,838 | 12/1986 | Love | 110/347 |
| 4,646,637 | 3/1987 | Cloots | 110/245 |
| 4,671,251 | 6/1987 | Anderson et al. | 126/99 |
| 4,685,220 | 8/1987 | Meenan et al. | 34/10 |
| 4,699,721 | 10/1987 | Meenan et al. | 210/771 |
| 4,790,250 | 12/1988 | Turner | 110/165 A |
| 4,970,971 | 11/1990 | Williams | 110/346 |
| 5,093,085 | 3/1992 | Engstrom et al. | 110/165 A |

*Primary Examiner*—Henry C. Yuen

*Attorney, Agent, or Firm*—Polster, Lieder, Woodruff & Lucchesi

[57] ABSTRACT

A waste material combustion apparatus for disposing of an assortment of waste material like garbage, sludge and burnable trash in which the ash produced as a result of combustion of that assorted material is collected and transported to a bag house where the ash solids are separated, the air is released to atmosphere, and the separated ash residue is collected as a product of the combustion.

4 Claims, 1 Drawing Sheet

WASTE MATERIAL COMBUSTION ASH EJECTION SYSTEM

BACKGROUND OF THE INVENTION

1. Field of the Invention

The present invention is directed to a system for ejecting the ash from combustion apparatus for disposing of sludge, garbage and the like and to a venturi system for clearing the ash discharge from the combustor.

2. Description of the Prior Art

There is a continuing problem in how to effectively dispose of sludge, garbage and similar waste materials other than by land fill disposal. The present approach is to employ expensive and sometimes inefficient ash removal from fluid bed combustors. The known prior art is limited in its teaching to a solution for only some of the present problems where the ash tends to clump and form clinkers which choke the ash discharge.

Attempts have been made to dispose of sludge by first drying the moisture from the sludge and then conveying it into combustion equipment where outside fuel is used in large quantities in order to sufficiently dry the sludge to a condition where it can be carted away to a land fill installation, or be otherwise disposed of. Examples of prior art apparatus for waste disposal include: U.S. Pat. No. 4,593,477, date Jun. 10, 1986; U.S. Pat. No. 4,608,944 date Sept. 2, 1986; U.S. Pat. No. 4,628,838, date Dec. 16, 1986; U.S. Pat. No. 4,646,637, date Mar. 3, 1987; U.S. Pat. No. 4,671,251, date Jun. 9, 1987; U.S. Pat. No. 4,685,220, date Aug. 11, 1987; and U.S. Pat. No. 4,699,721, date Oct. 13, 1987.

A BRIEF SUMMARY OF THE INVENTION

The invention is directed to a system, the object of which is to convert garbage, waste and sludge in a furnace where it can be reduced to a hot ash by combustion and then effect the collection of ash that has been sanitized.

The present invention has as a primary object the destruction by combustion of most any character of waste from sources such as sewage, paper mill sludge, and garbage to identify types of sources of waste material so that environmentally acceptable ash is produced.

Another object of the present invention is to regulate the discharge from the combustor so that the ash formed at high temperature can be discharged from the combustor by an air supply to drop the temperature in a final step to a level that will not be destructive of a bag house where the fine particulate matter is extracted while the vapor is returned to the ambient air.

The system also comprises an important ash removal technique with specific improvements to obtain greater efficiency in effecting disposal of the ash of combustion.

BRIEF DESCRIPTION OF THE DRAWINGS EMBODIMENT FOR THIS INVENTION

The system of this invention is disclosed in a single schematic diagram arranged to provide an operational arrangement of components to make up a waste material system for disposal of burnables to a form of innocent ash.

DETAILED DESCRIPTION OF THE PREFERRED EMBODIMENT

Figure 1:
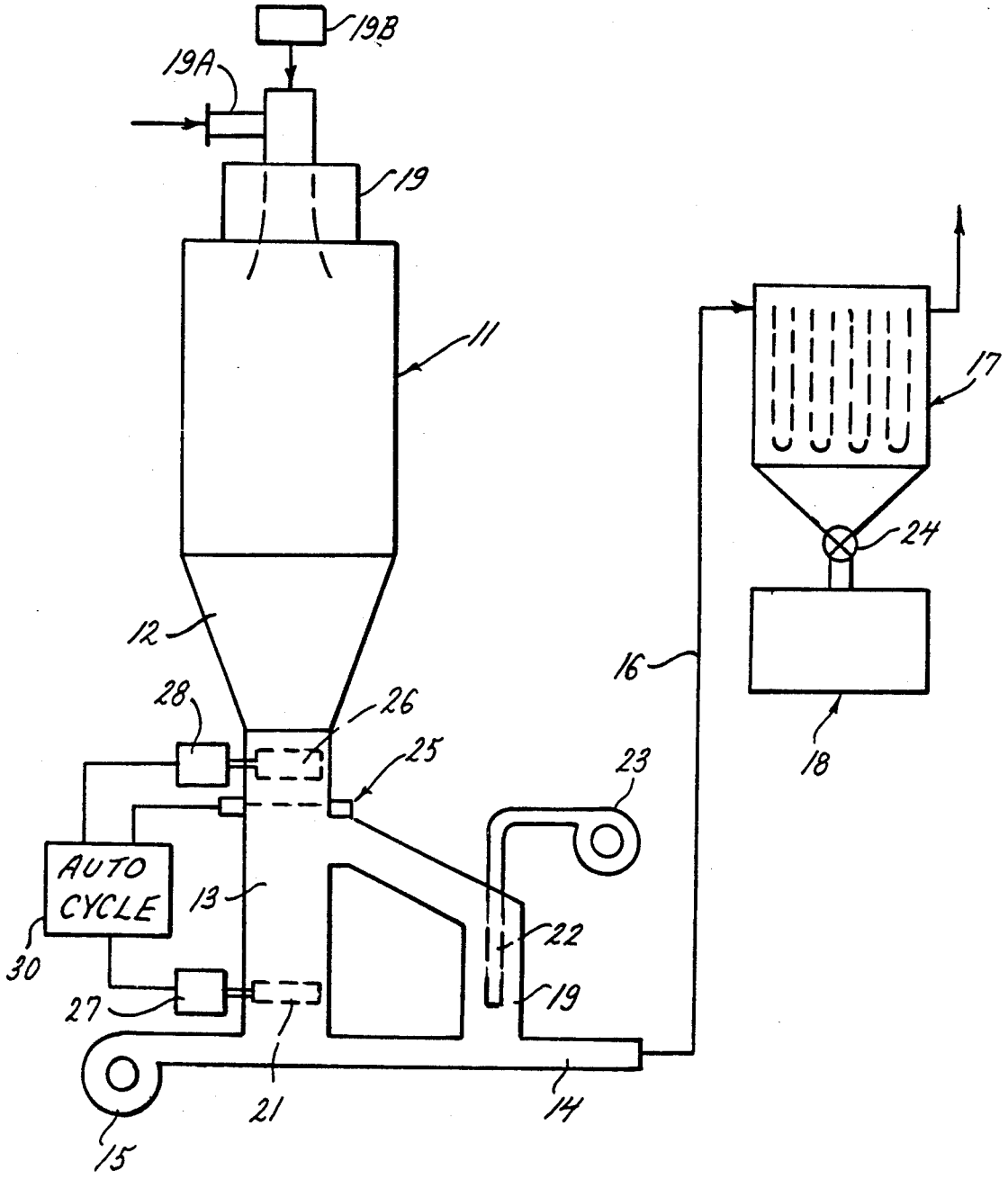

In the schematic view of the accompanied drawing there is disclosed an organization in which the material to be disposed of by combustion is supplied at 10 to a combustion device 11. An example of how waste material is disposed of is seen in Williams patent 4,970,971 where the combustor is supplied with fuel in the form of waste material.

The combustor 11 and the items of equipment associated therewith make up a material disposal system for effectively reducing, in a somewhat final manner, all of the sludge and waste material mixture as ash. The system comprises an ash receiver 12 having a discharge conduit 13 which connects into an air transport conduit 14 forming the pressure outlet of a blower 15. That conduit 14 has an extension conduit 16 that leads into the top of a bag house 17 which collects the ash and directs it into a bin 18.

The combustor 11 is normally a fire brick lined structure which is capable of using the fuel admitting to the burner 19 at feed inlet 19A, and an outside fuel source 19B is available to support combustion and develop at least a temperature of the order of 1650° F. that will effectively sanitize the ash which is normally objectionable because of its sludge type beginning. The fuel delivered to inlet 19A may be of the character described in the Williams patent U.S. Pat. No. 4,970,971 which is incorporated herein by reference, or from other suitable source.

It can be seen in the schematic view that the furnace 11 is provided with a primary ash discharge conduit 13 having an outlet open at the bottom to the air transport conduit 14. The primary discharge conduit 13 has a secondary ash discharge conduit 19 connected at one end to the primary conduit 13 and at an opposite end connected into the air transport conduit 14. Since the air transport conduit 14 is supplied from a blower 15, it is important that the bottom end of the primary conduit 13 should be normally closed by a gate 21 to prevent the ash being blown back in the conduit 13.

With respect to the secondary ash discharge conduit 19 having its open end connected into the air transport conduit 14, it is necessary to provide an ash ejection nozzle 22 connected to a source of air pressure from blower 23 so that ash collecting above the closed gate 21 will be at a temperature to melt and form lumps sufficient to block ash flow into the secondary conduit 19. As the collection piles up a detecting device 25 will cycle gates 21 and 26 to cycle those gates so the ash will be forcibly ejected by the air flow from nozzle 22 into the air transport conduit 14. In this manner the hot ash is picked up in the air transport conduit 14 and delivered by a conduit 16 to the bag house 17 where the solids in the ash are directed through a rotary gate 24 to flow into an ash collecting bin 18.

The normally closed gate 21 in the primary ash discharge conduit 13 allows the hot ash to accumulate and it eventually will back up in that conduit 13 until the level reaches a detecting device 25 which is intended to sound an alarm that will result in the closing of a normally open gate 26 which is inserted just above the detecting device 25 whereby the opening of gate 21 and the closing of the gate 26 has the effect of allowing the ejection of the accumulation of ash in the primary and secondary conduits 13 and 19 respectively.

The detecting device 25 can be an infrared element which peers through the primary conduit 13 so that the beam is interrupted when the accumulation of ash gets that high in the primary conduit 13. Upon the interruption of the light beam in the detecting device 25, the automatic cycling control 30 operates the motor means 27 for the normally closed gate 21 and motor means 28 for the normally open gate 26 so that the gates alternate in open and closed positions, thereby reducing the accumulation of the ash while preventing the air pressure in the transport conduit 14 from causing a blow back into the furnace ash receiver 12. When the ash drops below the detecting device 25, the control 30 retores the gates so gate 26 remains open and gate 21 remains closed.

A preferred embodiment of the present invention has been described in connection with the drawing views so as to illustrate a possible organization of equipment to practice a method for disposing by incineration of hot waste material. That hot waste material can be disposed of by performing multiple steps in its handling as it is discharged from the furnace 11, the essential step is to periodically have the detection device 25 alert the auto cycle 30 to alternate the opening and closing of the gates 21 and 26 for the purpose above referred to. Since the gate 21 is normally closed the hot ash accumulating against that closed gate will be at a temperature that may cause melting of the ash into clumps which will build up toward interfering with the connection of the secondary discharge conduit 19, and that build up will eventually be detected by the device 25. The ash that has melted into clumps against the gate 21 will be effectively discharged by closing the gate 26 and opening the gate 21, thereby clearing the primary and secondary ash discharge conduits 13 and 19 respectively so that the gates 21 and 26 will again go into a normal condition where the gate 21 is closed and the gate 26 is open.

In its preferred arrangement the furnace 11 has an ash discharge assembly composed of the primary and secondary ash passages 13 and 19, gate means 21 and 26, ash level detection means 25, and an auto cycle control 30. This assembly has a unique function of getting the ash to move into the ash conveyor so that the ash will not accumulate. Since one gate is normally closed the presence of the fluid pressure nozzle 22 performs the function of discharging the ash overflow from the primary ash passage until such time as ash slag formation in the primary passage causes a predetermined accumulation.

What is claimed is:

1. A waste material combustion ash ejection system for the discharge of the hot ash resulting from combustion, the system comprising:

a) a furnace having a primary elongated ash discharge conduit formed with a discharge end;

b) air transport means connected to said discharge end of said primary ash discharge conduit;

c) a secondary ash discharge conduit connected into said primary ash discharge conduit at one end and connected into said air transport means at an opposite end;

d) a normally open first gate means operably disposed in said primary ash discharge conduit in advance of said secondary ash discharge conduit connection at said one end;

e) a normally closed second gate means operably disposed in said primary ash discharge conduit adjacent said discharge end connected to said air transport means;

f) an air ejection nozzle mounted in said secondary ash discharge conduit, said nozzle being aimed toward said opposite end of said secondary ash discharge conduit; and g) a source of air connected to said ejection nozzle for supplying air at a pressure in excess of the pressure in said air transport means for effecting the discharge of ash into said air transport means.

2. The system set forth in claim 1 wherein detection means is disposed adjacent said normally open first gate to detect the presence of ash accumulating in said primary ash discharge conduit.

3. The system set forth in claim 2 wherein means responsive to said detection means is operably connected to said first and second gate means for cycling said gate means between open and closed positions for reducing the ash accumulation in said primary ash discharge conduit.

4. Apparatus for reducing waste material to an ash residue by combustion, the apparatus comprising:

a) a furnace having a combustion chamber for initiating the combustion of the waste material;

b) an ash discharge assembly for said furnace having primary and secondary ash discharge passages, said secondary passage having an inlet opening to said primary passage to receive ash from said primary passage;

c) a pressurized ash conveying conduit having separate openings communicating respectively with said primary and secondary passages;

d) first gate means operably positioned in said ash collecting assembly to control the ash discharge to said primary and secondary passage;

e) second gate means operably positioned in said primary ash discharge passage adjacent said ash conveying conduit to control ash discharge from said primary passage;

f) means operably connected to said first and second gate means for normally positioning said first gate means in a closed position to accumulate ash in said primary passage to a level which causes ash to flow into said secondary ash passage;

g) fluid pressure nozzle means in said secondary ash passage to propel the ash in said secondary ash passage to move into said pressurized ash conveying conduit; and h) control means in said ash collecting assembly positioned to respond to a predetermined accumulation of ash in said primary ash collecting passage for opening said first gate means and closing said second gate means alternately to reduce the ash accumulation.

* * * * *